United States Patent [19]

Sutcliffe et al.

[11] 3,971,017

[45] July 20, 1976

[54] METHOD AND APPARATUS FOR EXCITING THE DRIVING COILS OF AUDIBLE WARNING DEVICES

[75] Inventors: Henry Sutcliffe, Worsley; Edward Ball, Chadderton, both of England

[73] Assignee: Penelopegay Rowland Absalom, Great Missenden, England

[22] Filed: Apr. 30, 1975

[21] Appl. No.: 573,229

[52] U.S. Cl. ..... 340/384 E; 340/384 R

[51] Int. Cl.[2] ..... G08B 3/00

[58] Field of Search ..... 340/384 E, 384 R; 331/107, 111, 117, 64; 328/171, 267

[56] References Cited

UNITED STATES PATENTS 3,569,963 3/1971 Mallory ..... 340/384 E

*Primary Examiner*—Harold I. Pitts

*Attorney, Agent, or Firm*—Sughrue, Rothwell, Mion, Zinn & Macpeak

[57] ABSTRACT

Although audible devices such as warning devices have been operated from A.C. mains supplies the associated electrical and/or electronic circuitry has been bulky. The invention provides low bulk arrangement comprising first and second capacitor means, the effective capacitance of the two means being in series for connection across an alternating current mains supply, said second capacitor means having connected across it a rectifier and also the series combination of an electronic voltage sensitive switch and the operating means of the warning device, the arrangement being such that, in operation, the charge on the second capacitor means is periodically discharged through said operating means.

5 Claims, 3 Drawing Figures

METHOD AND APPARATUS FOR EXCITING THE DRIVING COILS OF AUDIBLE WARNING DEVICES

BACKGROUND OF THE INVENTION

This invention relates to circuit arrangement means for exciting audible devices, such as buzzers or warning device.

In known arrangements audible warning devices which usually operate from voltages which are unidirectional and lower than mains supply voltage may be driven from an alternating current mains supply but conventionally the associated electrical and/or electronic circuits tend to be bulky.

An object of the present invention is to provide a novel arrangement which may be designed to have low bulk.

According to the invention, there is provided a circuit arrangement means for exciting an audible device, comprising first and second capacitor means, the effective capacitance of the two means being in series for connection across an alternating current mains supply, said second capacitor means having connected across it a rectifier and also the series combination of an electronic voltage sensitive switch and the operating means of the warning device, the arrangement being such that, in operation, the charge on the second capacitor means is periodically discharged through said operating means.

Preferably the first capacitor means has a smaller capacitance value than that of the second capacitor means and the second capacitor means is of the electrolytic type.

BRIEF DESCRIPTION OF THE DRAWINGS

An embodiment of the invention will now be described by way of example with reference to the accompanying drawing, in which.

DESCRIPTION OF THE PREFERRED EMBODIMENT

Figure 1:
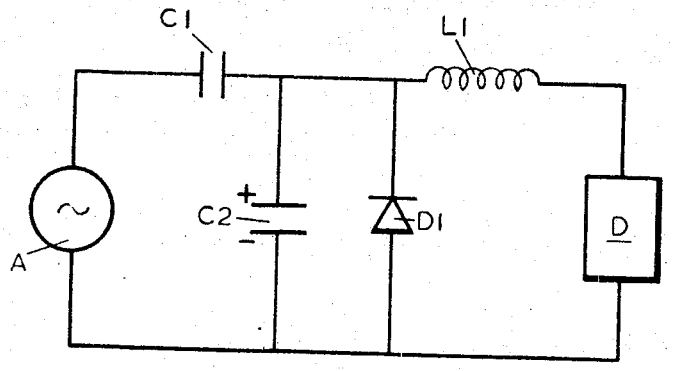
FIG. 1 is a schematic circuit diagram of a means, in accordance with the invention.

Referring to FIG. 1, a source of alternating current mains supply A of $V_1$, typically 240 volts r.m.s. at 50 Hz was connnected across it a capacitor potential divider formed by capacitors C1 and C2 across the latter of which is a diode D1 which protects capacitor C2 from reverse voltage and at the same provides a unidirectional charge on capacitor C2. Also connected across capacitor C2 is the exciting coil L1 of a buzzer in series with an electronic switch D which becomes conductive when the voltage across it exceeds a predetermined value, for example in the range 10 to 100 volts.

In operation, if the switch D were to remain nonconductive, a diminished alternating voltage with a superimposed D.C. component would appear across capacitor C2. However, in practice, the voltage across capacitor C2 rises along the sinusoidal curve until the breakdown voltage of switch D is reached whereupon switch D discharges the instantaneous charge on capacitor C2 through the coil L1 providing a large impulse of current. Although heavily damped, the resonant circuit of, principally, capacitor C2 and coil L1 rings sufficiently to reverse the voltage across switch D and thus ensures that is becomes non-conductive. A recharging of capacitor C2 to the breakdown voltage of switch D takes place during the next rise of sinusoidal voltage a cycle later. The coil L1 thus receives a pulse of current at, in the example, 50 times per second.

The magnitude of the pulse is determined, inter alia, by the capacitance of capacitor C2 and is therefore limited if small physical size is required. The arrangement in accordance with the invention maintains a uni-directional voltage across capacitor C2 and therefore enables an electrolytic type to be used with the known advantage of reduced physical size for a given capacitance. The voltage across capacitor C1 is bidirectional and therefore an electrolytic type cannot be used. However its capacitance is less by, for example, a factor of 5 or 6 and this still enables a small physical size to be obtained in a non-electrolytic type of sufficient voltage rating to withstand voltages up to or near mains voltage.

The switch D may be any voltage sensitive switch but preferably is one which triggers into conduction in a cumulative manner once a predetermined voltage is developed across it and remains conductive until the voltage across it falls to the extinguishing value. Examples of such switches are shown in FIGS. 2 and 3.

Figure 2:
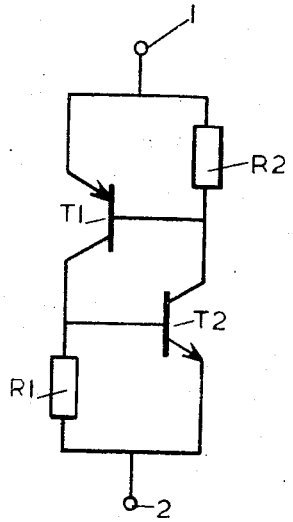
FIG. 2 is a circuit diagram of an example of electronic switch which may be used in the circuit of FIG. 1.

In FIG. 2, there is shown a complementary pair of bipolar transistors T1 and T2, each arranged with its respective collector load R1, R2 between the terminals 1 and 2 of the switch. Cumulative trigger action is obtained by cross-coupling the base of one with the collector of the other. In operation, as the voltage across terminals 1 and 2 rises the leakage current in the base-collector circuit causes an increase in the voltages developed across resistors R1 and R2 and hence in an increase in the base-emitter and emitter-collector circuit currents until triggering takes place.

Figure 3:
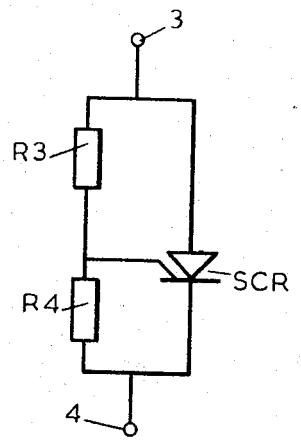
FIG. 3 is a circuit diagram of another example of an electronic switch which may be used in the circuit of FIG. 1.

FIG. 3 shows another suitable circuit comprising a silicon controlled rectifier (SCR) connected between terminals 3 and 4. A potentiometer of resistors R3 and R4 is also connected across the terminals, the intermediate point being connected to the gate electrode. As the voltage across terminals 3 and 4 rise the gate voltage rises until the threshold is reached whereupon conduction through the SCR rapidly ensues.

In both examples conduction continues until the extinguishing voltage or current is reached and the switches then becomes non-conductive until triggered again.

In one example of the circuit arrangement described all the electrical components were accommodated within a small cylindrical container which was itself the electro-acoustic transducer, i.e. buzzer.

What is claimed is: operating

1. A circuit arrangement means for exciting an audible device, comprising first and second capacitor means, the effective capacitance of the two means being in series for connection across an alternating current mains supply, said second capacitor means having connected across it a rectifier and also the series combination of an electronic voltage sensitive switch and the operaing means of the warning device, the arrangement being such that, in operation, the charge on the second capacitor means is periodically discharged through said operating means.

2. A circuit arrangement means as claimed in claim 1 wherein the first capacitor means has a smaller capacitance value than that of the second capacitance means.

3. A circuit arrangement means as claimed in claim 2, wherein the second capacitor means is an electrolytic type capacitor and the rectifier is poled to prevent adverse reverse voltages from being developed thereacross.

4. A circuit arrangement means as claimed in claim 1, wherein the electronic switch comprises a complementary pair of cross-coupled bipolar transistors arranged to become conductive when the voltage across the switch reached a predetermined threshold value.

5. A circuit arrangement means as claimed in claim 1, wherein the electronic switch comprises a silicon controlled rectifier circuit in which the gate electrode is connected to the intermediate point of a potentiometer connected across the rectifier.

* * * * *